US008113393B2

(12) United States Patent
Ho

(10) Patent No.: US 8,113,393 B2
(45) Date of Patent: Feb. 14, 2012

(54) COLLAPSIBLE HOOK HANGER

(75) Inventor: Leung Ho, Kowloon (HK)

(73) Assignee: The Build-Up Plastic & Metal Co., Ltd., Kowloon (HK)

( * ) Notice: Subject to any disclaimer, the term of this patent is extended or adjusted under 35 U.S.C. 154(b) by 204 days.

(21) Appl. No.: 12/419,754

(22) Filed: Apr. 7, 2009

(65) Prior Publication Data

US 2009/0283556 A1 Nov. 19, 2009

Related U.S. Application Data

(60) Provisional application No. 61/122,598, filed on Dec. 15, 2008, provisional application No. 61/042,990, filed on Apr. 7, 2008.

(51) Int. Cl.
*A41D 27/22* (2006.01)

(52) U.S. Cl. ..... 223/85; 223/92; 223/DIG. 4

(58) Field of Classification Search ..... 223/85, 223/88, 89, 92, 94, 95, DIG. 4
See application file for complete search history.

(56) References Cited

U.S. PATENT DOCUMENTS

| | | | | |
|---|---|---|---|---|
| 881,818 | A | 3/1908 | Morrison, Jr. et al. | |
| 1,893,815 | A | 10/1930 | Wilt, Jr. et al. | |
| 2,425,527 | A | 7/1945 | Gaudino | |
| 2,519,276 | A | 8/1950 | Needles et al. | |
| 3,726,452 | A * | 4/1973 | Jaffe | 223/91 |
| 4,063,670 | A | 12/1977 | Faarbech | |
| 4,168,791 | A | 9/1979 | Clark, Jr. | |
| 4,221,298 | A * | 9/1980 | Wright et al. | 223/85 |
| 4,905,877 | A | 3/1990 | Gatling | |
| 4,932,571 | A | 6/1990 | Blanchard | |
| 4,997,115 | A | 3/1991 | Jolley | |
| 5,007,562 | A | 4/1991 | Brink et al. | |
| 5,085,357 | A | 2/1992 | Chen | |
| 6,000,587 | A * | 12/1999 | Sackett et al. | 223/85 |
| 7,021,507 | B2 | 4/2006 | Choi et al. | |
| 7,243,823 | B2 | 7/2007 | Cresap et al. | |
| 7,246,729 | B2 | 7/2007 | Harvey et al. | |
| 7,249,699 | B2 | 7/2007 | Hill et al. | |
| 7,837,074 | B2 * | 11/2010 | Rude et al. | 223/85 |
| 2006/0006204 | A1 * | 1/2006 | Mainetti | 223/85 |
| 2006/0213938 | A1 * | 9/2006 | Gouldson | 223/85 |
| 2006/0278670 | A1 * | 12/2006 | Gouldson | 223/85 |
| 2007/0175932 | A1 * | 8/2007 | Wu | 223/85 |
| 2007/0199963 | A1 * | 8/2007 | Gouldson | 223/85 |
| 2007/0272716 | A1 * | 11/2007 | Wu | 223/85 |
| 2008/0283558 | A1 | 11/2008 | Rude et al. | |

FOREIGN PATENT DOCUMENTS

| | | |
|---|---|---|
| WO | WO 98/46107 | 10/1998 |

* cited by examiner

*Primary Examiner* — Nathan Durham
(74) *Attorney, Agent, or Firm* — Hoffman & Baron, LLP

(57) ABSTRACT

A collapsible hook hanger having a metal hook moveable between an upright position for displaying garments and a folded position for reducing the footprint of the hanger during packaging/transportation of pre-hung garments.

10 Claims, 20 Drawing Sheets

COLLAPSIBLE HOOK HANGER

This application claims the benefit of U.S. Provisional Application Ser. No. 61/122,598 filed Dec. 15, 2008 and U.S. Provisional Application Ser. No. 61/042,990 filed Apr. 7, 2008, the disclosures of which are hereby incorporated by reference in their entirety.

BACKGROUND OF THE INVENTION

The present invention relates to garment hangers and, more particularly, to garment hanger having a collapsible hook.

Garment hangers featuring metal hooks are well-known in the art. These hangers typically include a threaded boss located on the upper frame, the threaded boss receiving a threaded end of the metal hook. The body of the hanger is typically made of plastic.

Many garments that are manufactured oversees are pre-hung on a hanger, and then shipped to the United States as a hanger/garment combination. In other words, the garment is hung on the appropriate hanger at the manufacturing location (e.g., the Far East), packaged into a shipping box or container, and shipped to the United States. Upon delivery to the retail location, the retailer simply has to remove the pre-hung garments from the shipping box/container, and hang such pre-hung garments in the retail store. Thus, there is no need for the retailer to incur time and cost hanging the individual garments on individual hangers.

Although garments can be tightly packed within the mentioned packaging boxes/containers, those skilled in the art will appreciate that the hooks of the garment hangers take up a significant volume of space within such boxes/containers. This additional space, of course, translates into additional shipping costs.

There is therefore a need in the art for a garment hanger which in addition to functioning as a conventional garment hanger in a retail location, is also capable of providing a reduced footprint during packaging/transportation.

SUMMARY OF THE INVENTION

The present invention, which addresses the needs of the prior art, relates to a collapsible hook hanger. The hanger includes a hook having a threaded end. The hanger further includes a hanger body defining a plane P and including an upper edge. The hanger also includes a hook-receiving fixture extending from the edge. The fixture includes a substantially circular opening extending therethrough in a direction substantially perpendicular to plane P. The fixture also includes a guide slot extending along a substantial portion of at least one of the sides of the fixture and along at least a portion of the top of the fixture. The guide slot is in communication with the aperture. Finally, the hanger includes a substantially circular drum sized to be rotatably received within the opening of the fixture. The drum includes a threaded aperture sized to receive the threaded end of the hook when the threaded end is extended through the guide slot whereupon the drum is rotatably captured within the opening of the fixture and rotatable between a first upright position and a second folded position.

As a result, the present invention provides a garment hanger which functions and operates as a conventional garment hanger in a retail location, but is designed to allow the hook to move between an upright position and a folded position whereupon the folded position provides a reduced footprint during packaging/transportation of pre-hung garments.

DETAILED DESCRIPTION OF THE INVENTION

Hanger 10, formed in accordance with the present invention, is shown in FIGS. 1-9. Hanger 10 includes a central body portion 12 defining a plane P, and a pair of opposing downwardly-depending arms 14. In one preferred embodiment, hanger 10 is formed with an I-beam construction. In another preferred embodiment, hanger 10 includes a coordinate loop 16 for receiving the hook of a second hanger (not shown).

Figure 1:
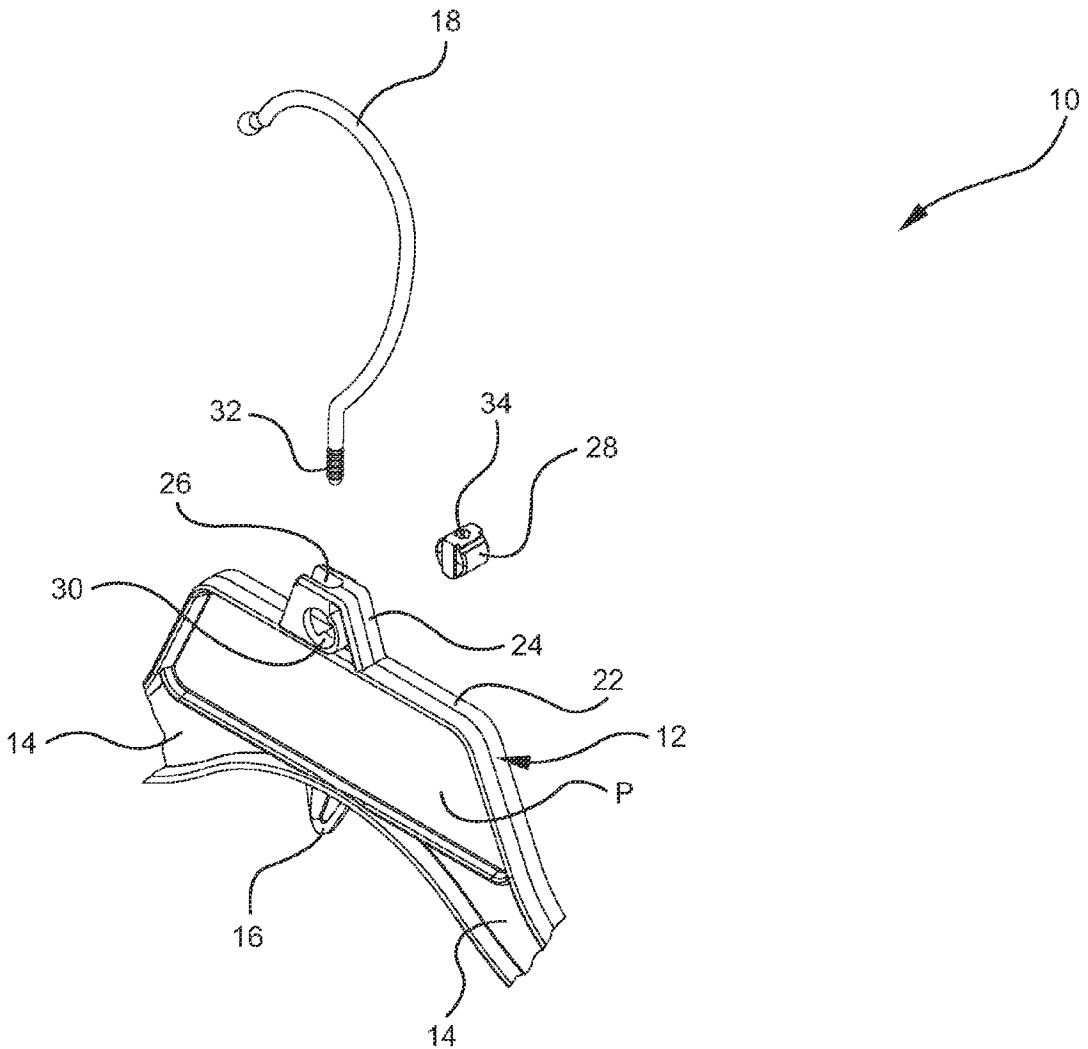
FIG. 1 is an exploded perspective view of the hanger of the present invention.
Figure 2:
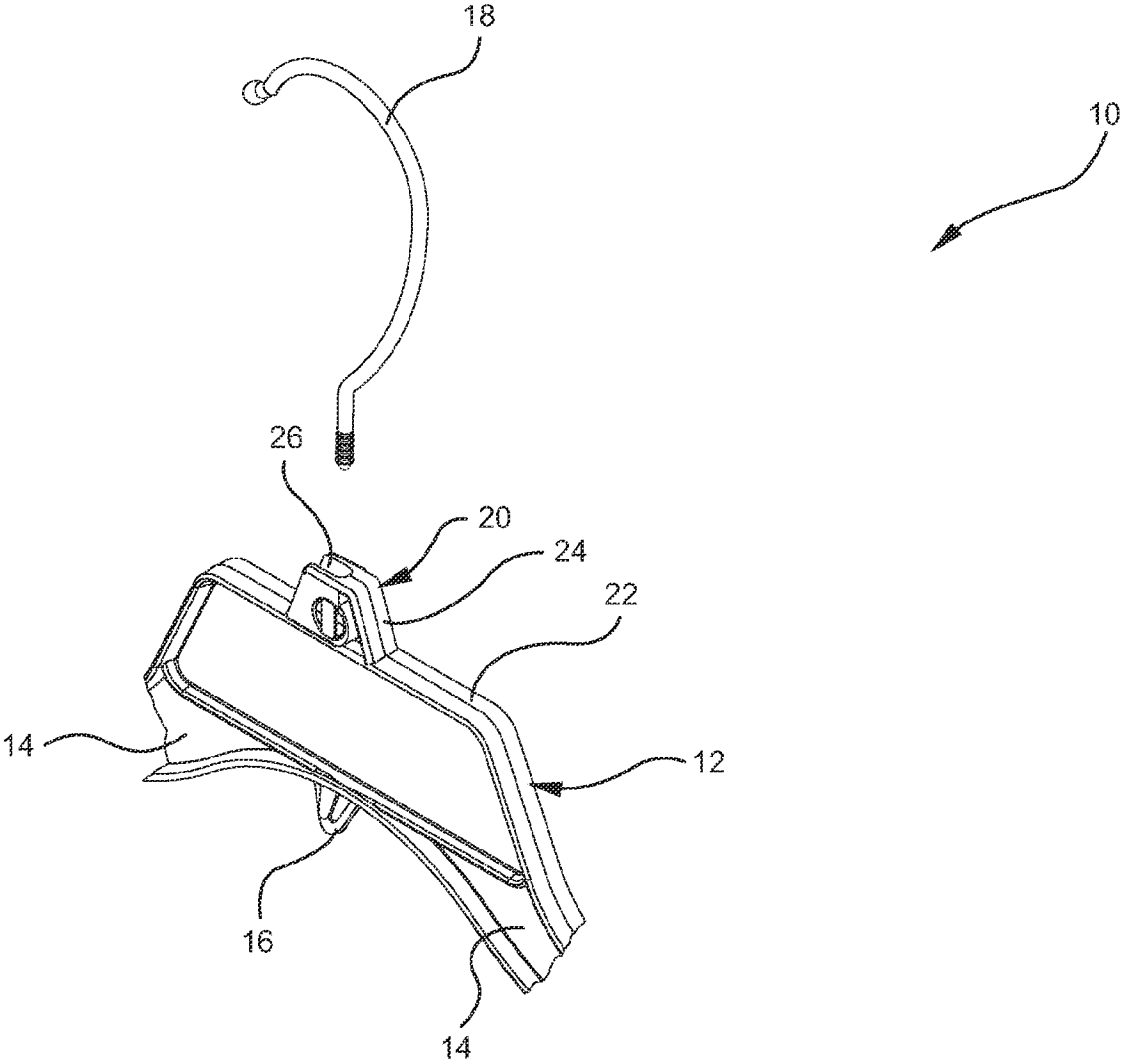
FIG. 2 is another exploded perspective view of the hanger of FIG. 1.
Figure 3:
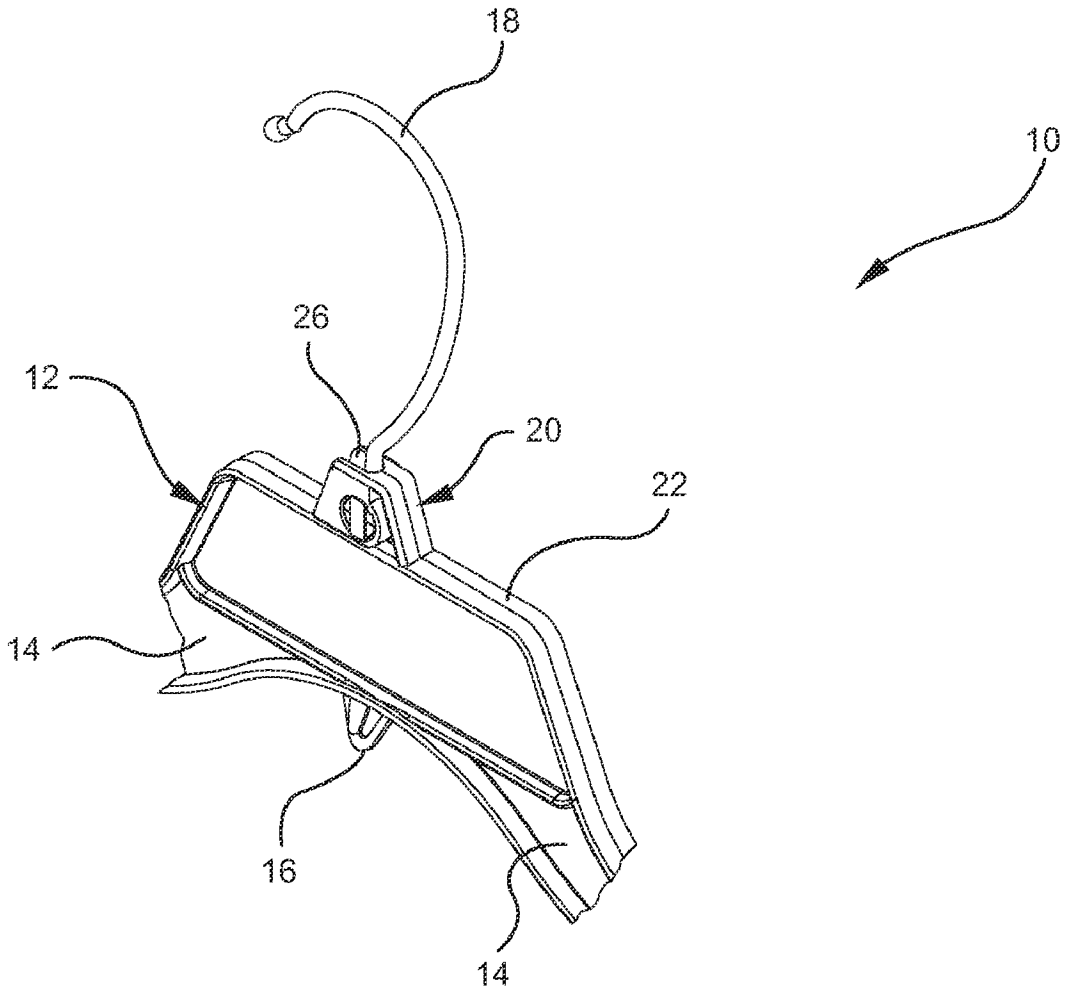
FIG. 3 is a perspective view of the hanger of FIG. 1 with the hook oriented in the upright position.
Figure 4:
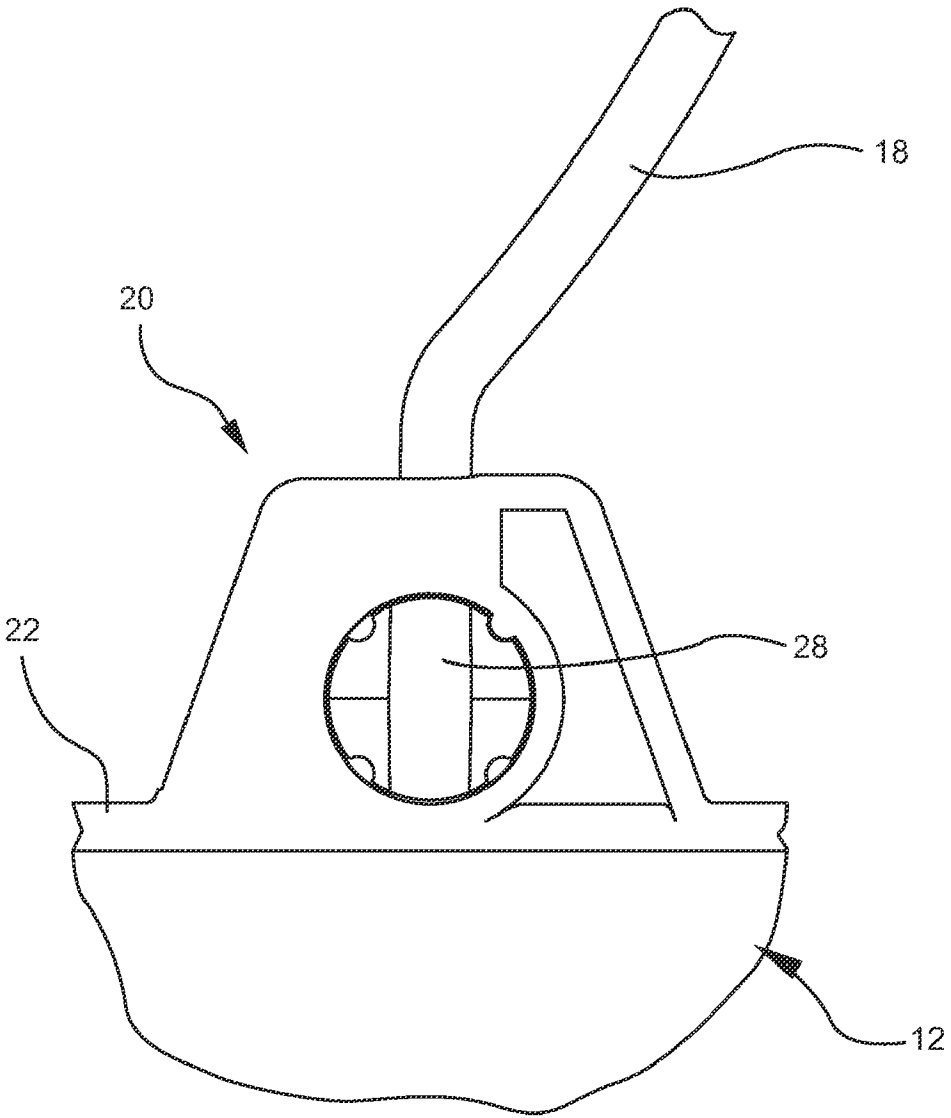
FIG. 4 is an enlarged detail of FIG. 3.
Figure 5:
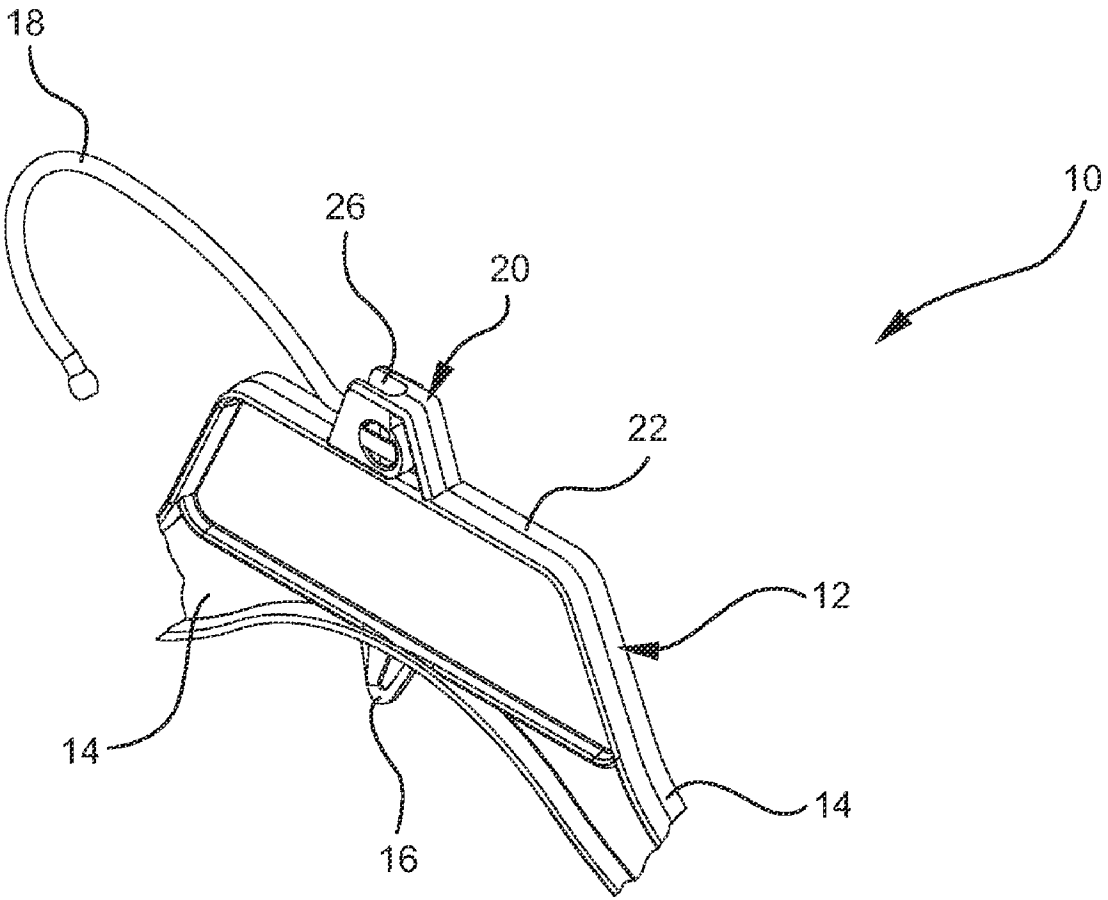
FIG. 5 is a perspective view of the hanger of FIG. 1 with the hook oriented in its folded position.
Figure 6:
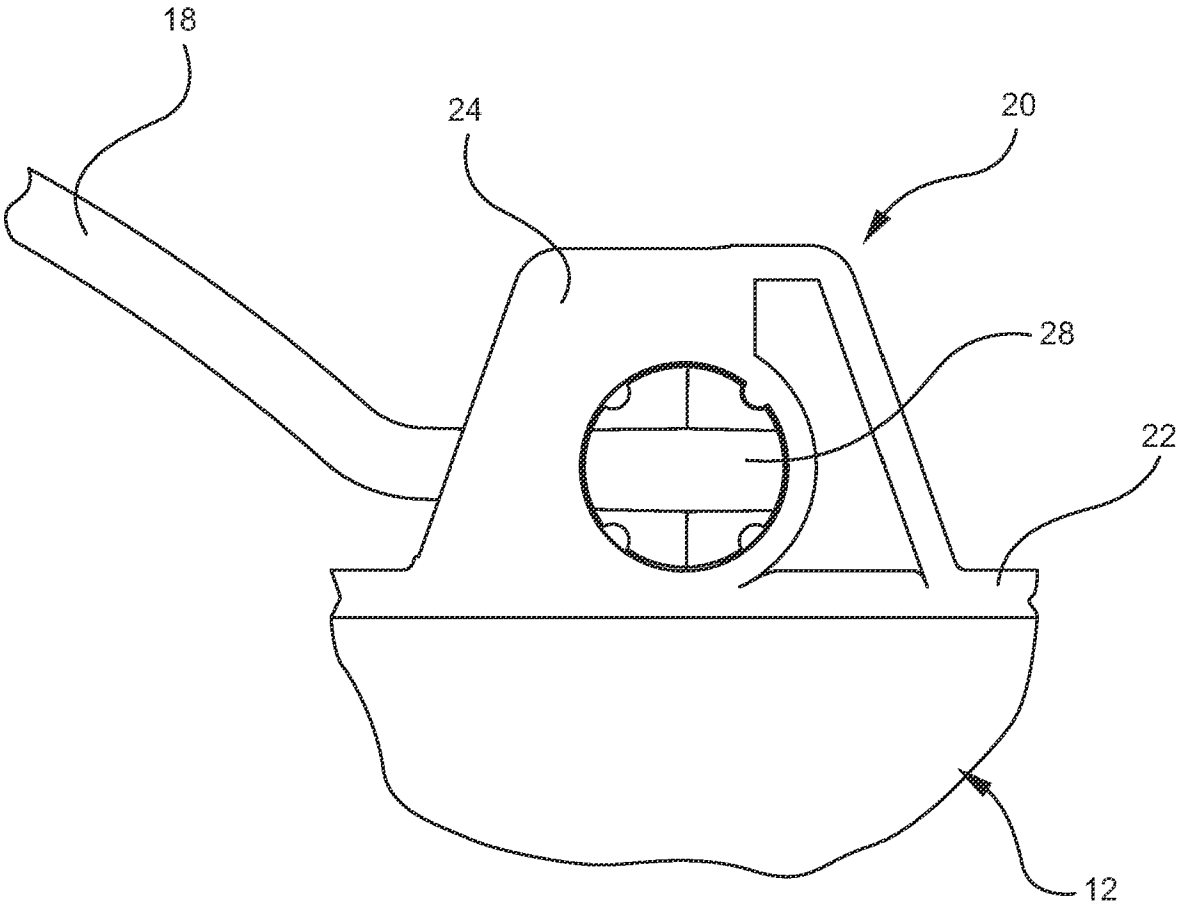
FIG. 6 is an enlarged detail of FIG. 5.

Hanger 10 includes a metal hook 18, which is shown in an upright position in FIG. 3 and in a folded position in FIG. 5. More particularly, hook 18 is rotatable between these two positions. When the hook is in the upright position, hanger 10 functions as a conventional garment hanger for supporting and displaying a garment. However, during transportation/shipping, hook 18 can be moved to the folded position to reduce the footprint of the hanger, and thus the overall size of the shipping box/container into which the garments are loaded. The reduction in size of the shipping box/container translates into reduced shipping costs.

Hanger 10 of the present invention includes a hook-receiving fixture 20 located along an upper edge 22 of body portion 12. Hook-receiving fixture 20 includes a frame 24, which is preferably integrally molded with edge 22. Frame 24 includes a guide slot 26 sized to receive the lower portion of hook 18 therein. Fixture 20 further includes a circular drum 28 sized to be rotatably received within an opening 30 extending through frame 24. After drum 28 has been positioned within opening 30, tip 32 of hook 18 is inserted and/or threaded into an aperture 34 formed in drum 26. Drum 28 is thereafter effectively retained within opening 30. More particularly, drum 28 can rotate within opening 34 between the upright position shown in FIG. 3, and the folded position shown in 5.

Figure 7:
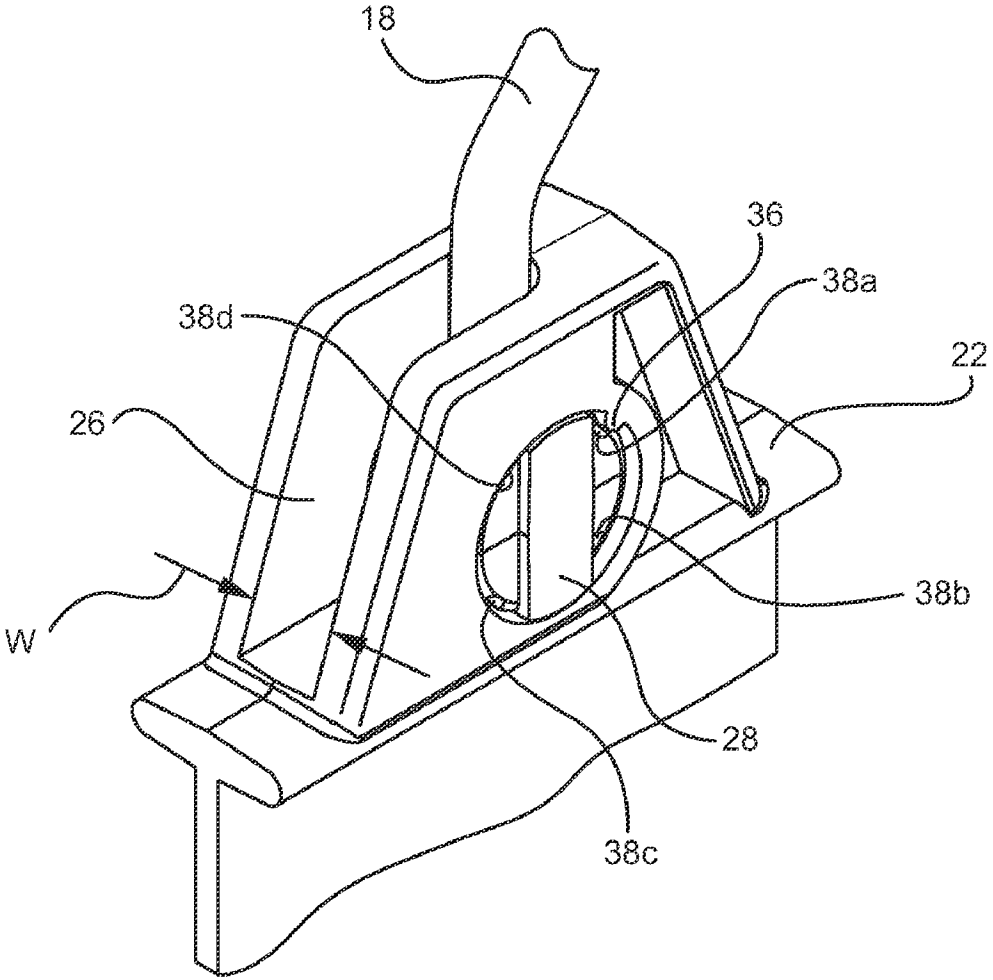
FIG. 7 is an enlarged detail showing the orientation of the drum when the hook is oriented in the upright position.
Figure 8:
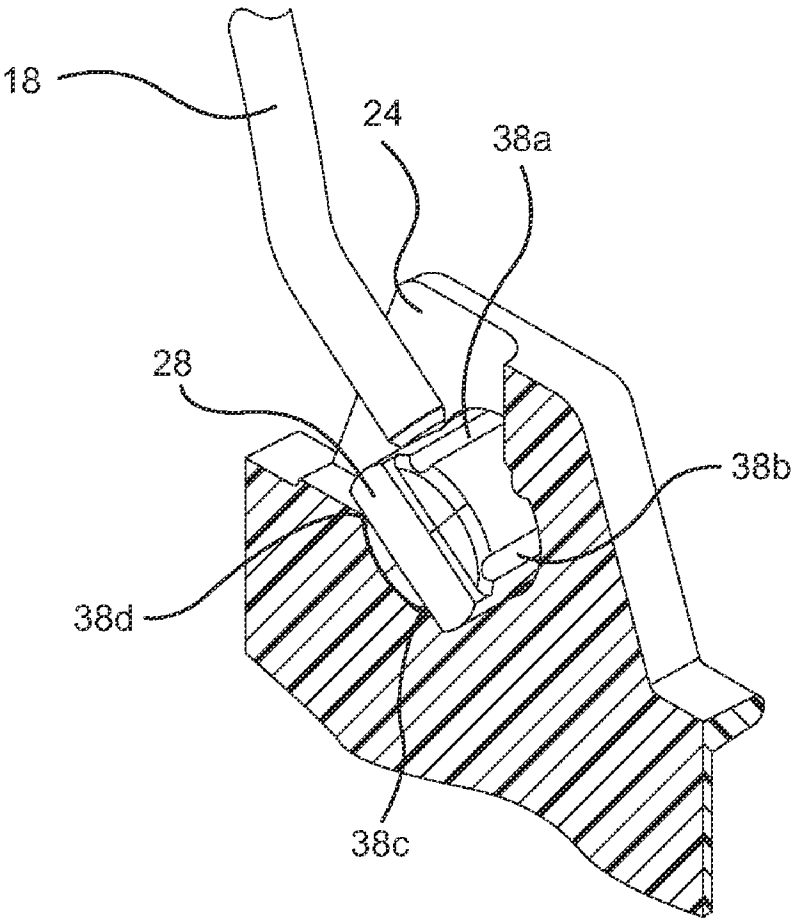
FIG. 8 is an enlarged detail showing the orientation of the drum when the hook is located between the upright position and the folded position.
Figure 9:
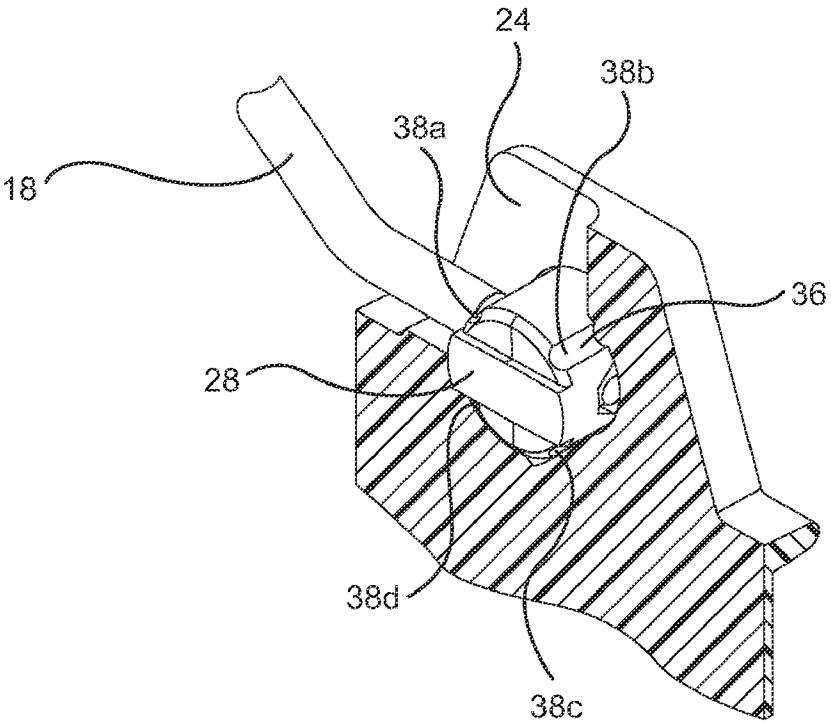
FIG. 9 is an enlarged detail showing the orientation of the drum when the hook is oriented in the folded position.

It will be appreciated by those skilled in the art that a collapsible hook hanger will preferably include a locking mechanism which locks the hook of the hanger in an upright position during normal usage, and in a folded position during transportation/shipping. The novel arrangement of the components of the present invention provides a mechanism which is cost effective to manufacture, easy to assemble and which provides for the mentioned locking mechanism. This locking arrangement is best seen in FIGS. 7-9. In particular, frame 24 is formed with at least one rib 36, while drum 28 is formed with a plurality of detents 38*a*-38*d*. When the hook is in the upright position (as shown in FIG. 7), rib 36 engages detent 38*a*. The engagement of rib 36 within detent 38*a* locks hook 18 in the mentioned orientation. To move hook 18 to the folded position, sufficient pressure must be applied to overcome the engagement forces between rib 36 and detent 38*a* and move the hook to the position shown in FIG. 8 (wherein rib 36 is positioned between detent 38*a* and 38*b*). Upon further rotation of the hook to the folded position shown in FIG. 9, rib 36 engages detent 38*b* thereby locking the hook in the folded position.

As discussed hereinabove, this folded state provides a reduced footprint for the hanger, thereby reducing the size of the packaging boxes/containers required to transport the garments positioned on the hangers. Once the hangers/garments reach the retail location, the garments/hangers are removed from the boxes/containers, and the hook is rotated from the folded position to the upright position.

In one preferred embodiment, frame 24 is formed with a second rib. This second rib may be included in applications where it is desirable to increase the locking force between the drum and the frame. More particularly, the addition of a second rib to frame 24 may be useful in applications where the end user is concerned about unwanted undesirable folding of the hook with respect to fixture 20. Of course, it is contemplated herein that frame 24 can include a plurality of ribs which will engage a corresponding number of detents formed in the drum, or that the ribs/detents can be located at various positions on the frame/drum. It is also contemplated herein that the ribs/detents can take other forms and configurations.

In another embodiment of the present invention, a locking mechanism may be formed within guide slot 26, either in addition to or in place of the locking mechanism shown in FIGS. 7-9. More particularly, guide slot 26 may be formed with a width W which is less than the diameter of the lower portion hook 18, and with an expanded region at each end thereof. This expanded region is sized to substantially correspond to the diameter of the lower portion of hook 18. Accordingly, the first expanded region receives the lower portion of hook 18 when hook 18 is oriented in the upright position, while the second expanded region receives hook 18 while hook 18 is oriented in the folded position. To move the hook from the upright position to the folded position, sufficient pressure must be applied to push the lower portion of the hook out of the first expanded region into the narrow guide slot extending therebetween. Once the hook is rotated a sufficient distant, the lower portion of the hook passes out of the slot and into the second expanded region, thus locking the hook into the folded position.

Figure 10:
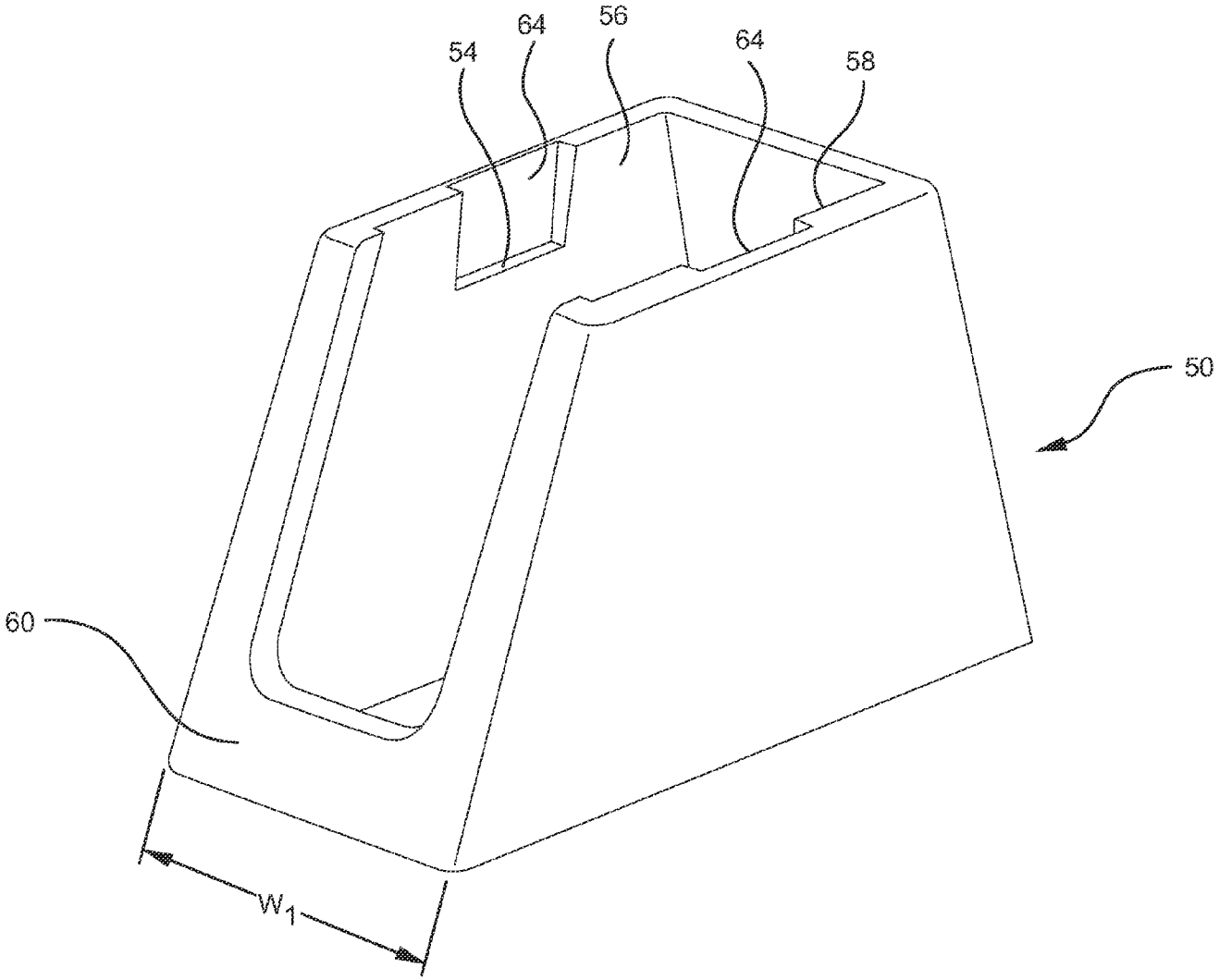
FIG. 10 is a perspective view of a crown sizer to be used in connection with the present invention.
Figure 11:
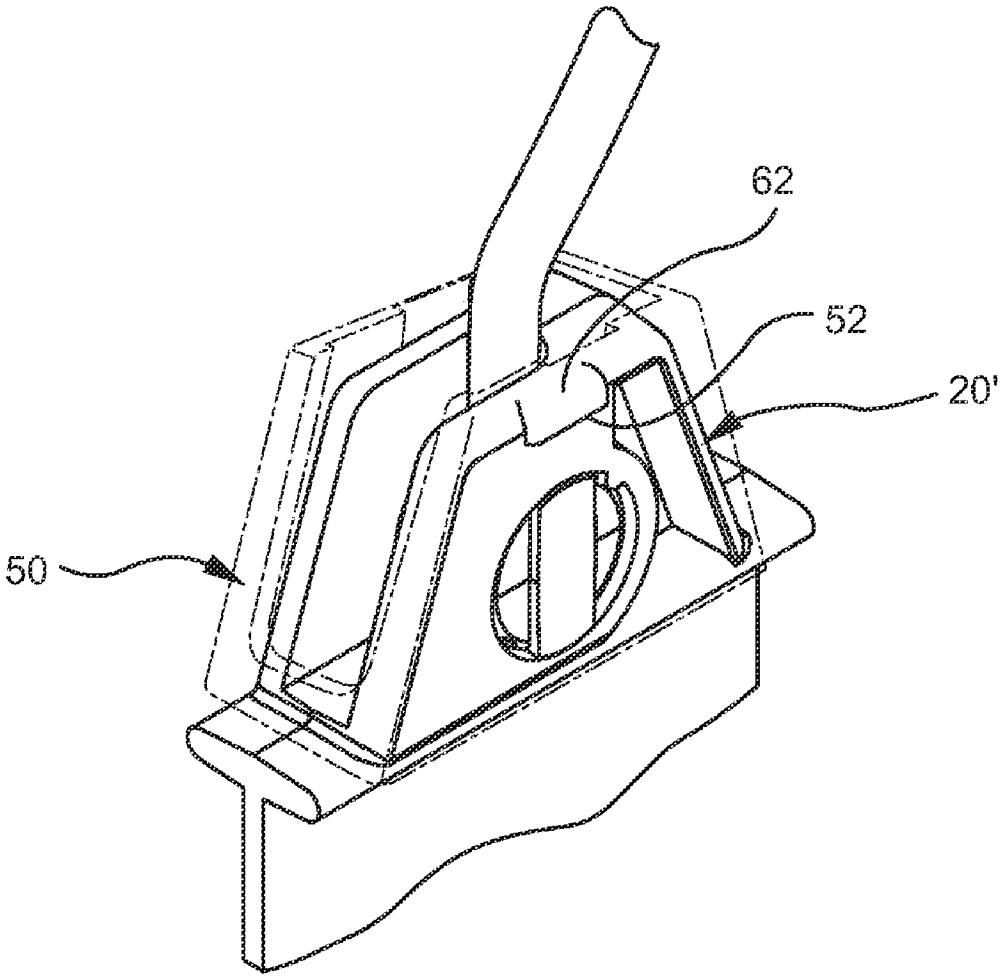
FIG. 11 is a perspective view similar to FIG. 10 showing the crown sizer of FIG. 10 installed about a second embodiment of the hook-receiving fixture.

Referring now to FIGS. 10-11, a crown sizer 50 is sized and configured to mount about a second embodiment of the hook-receiving fixture, i.e., fixture 20'. Fixture 20' is similar to fixture 20, but for the addition of two opposing and outwardly-protruding projections, e.g., lips 52. These lips are sized and located to cooperate with a pair of opposing shoulders 54 provided on the interior of opposing sidewalls 56, 58. In one preferred embodiment, the lips are located on the exterior surfaces of fixtures 20', and positioned along the upper edge in the substantial center thereof. As a result, once engaged with sizer 50, the lips are thereby positioned in the substantial center of sidewalls 56, 58. Such an arrangement facilitates installation because the center portion of sidewalls 56, 58 can be flexed more readily and to a greater degree (as the sizer is passed over the hook-receiving fixture) than other portions of the sizer. As best shown in FIG. 10, sidewall 60 is cut away to substantially correspond with guide slot 26 formed in the hook-receiving fixture. This of course allows hook 18 to move from the upright position to the folded position.

In one preferred embodiment, the locking interaction between lips 52 and shoulders 54 urges the bottom of the sizer into contact with upper edge 22, thereby reducing "rattling" of the sizer on the hanger. The locking interaction between lips 52 and shoulders 54 also makes removal of the sizer from the hanger more difficult. In one preferred embodiment, the overall width W at the bottom of sizer 50 is selected to substantially correspond to width Z of upper edge 22, thereby making it more difficult to "pry" the sizer off of the hanger while at the same time improving the overall aesthetics of the sizer/hanger combination.

In practice, sizer 50 is positioned over hook-receiving fixture 20', and thereafter pushed downward about such fixture, whereby sidewalls 56, 58 flex slightly outward to allow shoulders 54 to travel past lips 52. The upper portions 62 of lips 26 are preferably angled/beveled to facilitate installation. Once positioned, sidewalls 56, 58 of sizer 50 return to their unflexed state whereby shoulders 54 engage lower edges 62 of lips 52 thereby securing sizer 50 about fixture 20'.

Shoulders 54 are preferably formed by molding a notch 64 in each of sidewalls 56, 58. The use of a generally rectangular notch to form shoulders 54 facilitates the molding operation associated with the manufacture of sizers 50, e.g., by eliminating the need for a slide cam and allowing for easier mold modification. In other embodiments, the wall thickness may vary along the length of the notch and/or the notch may be formed with other geometric configurations.

Hanger 110, formed in accordance with another embodiment of the present invention, is shown in FIGS. 12-15. Hanger 110 includes a central body portion 112 defining a plane Q, and a pair of opposing downwardly-depending arms 114. In one preferred embodiment, hanger 110 is formed with an I-beam construction. In another preferred embodiment, hanger 110 includes a coordinate loop 116 for receiving the hook of a second hanger (not shown).

Figure 12:
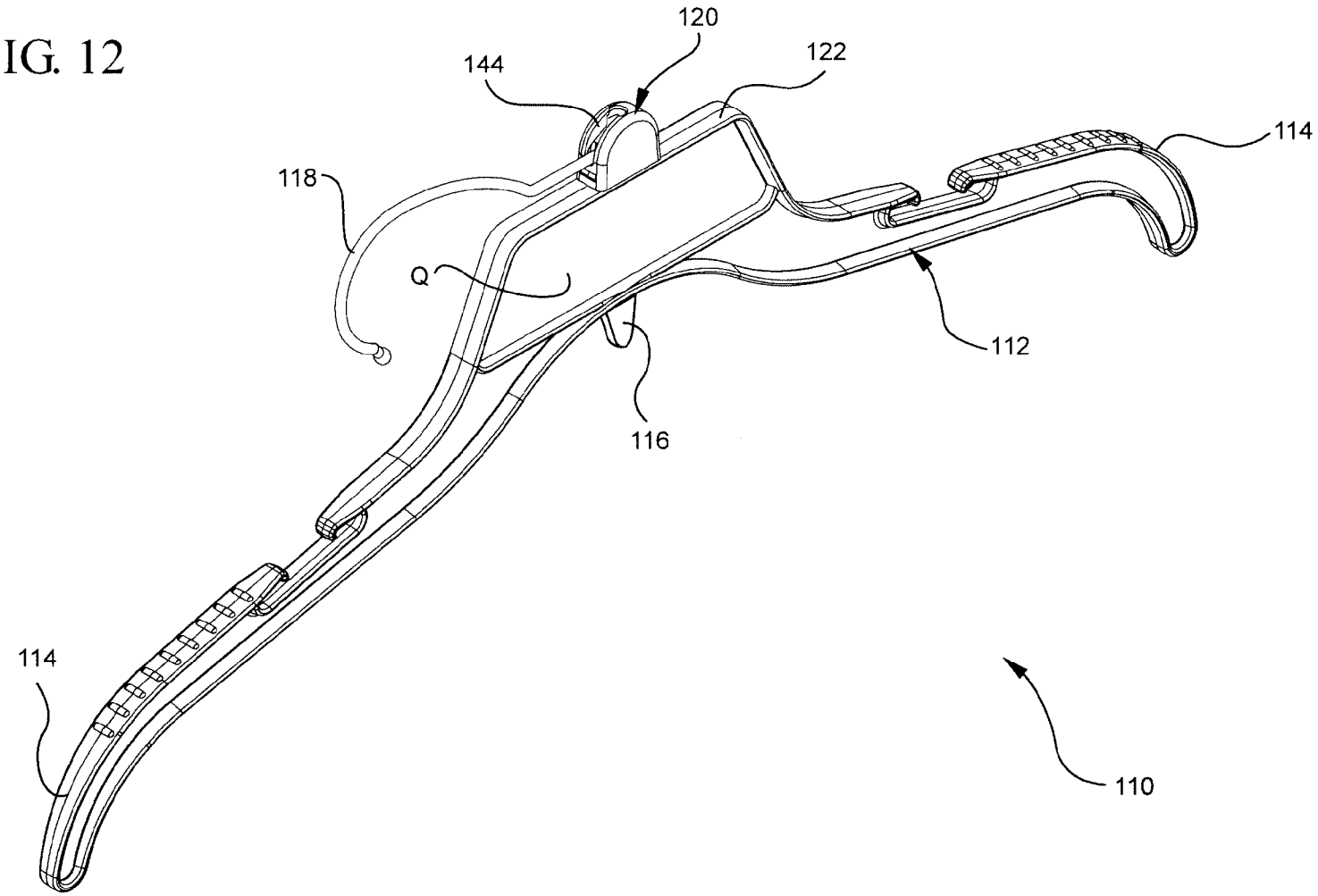
FIG. 12 is a perspective view of another embodiment of the hanger of the present invention with the metal hook in a folded position.
Figure 13:
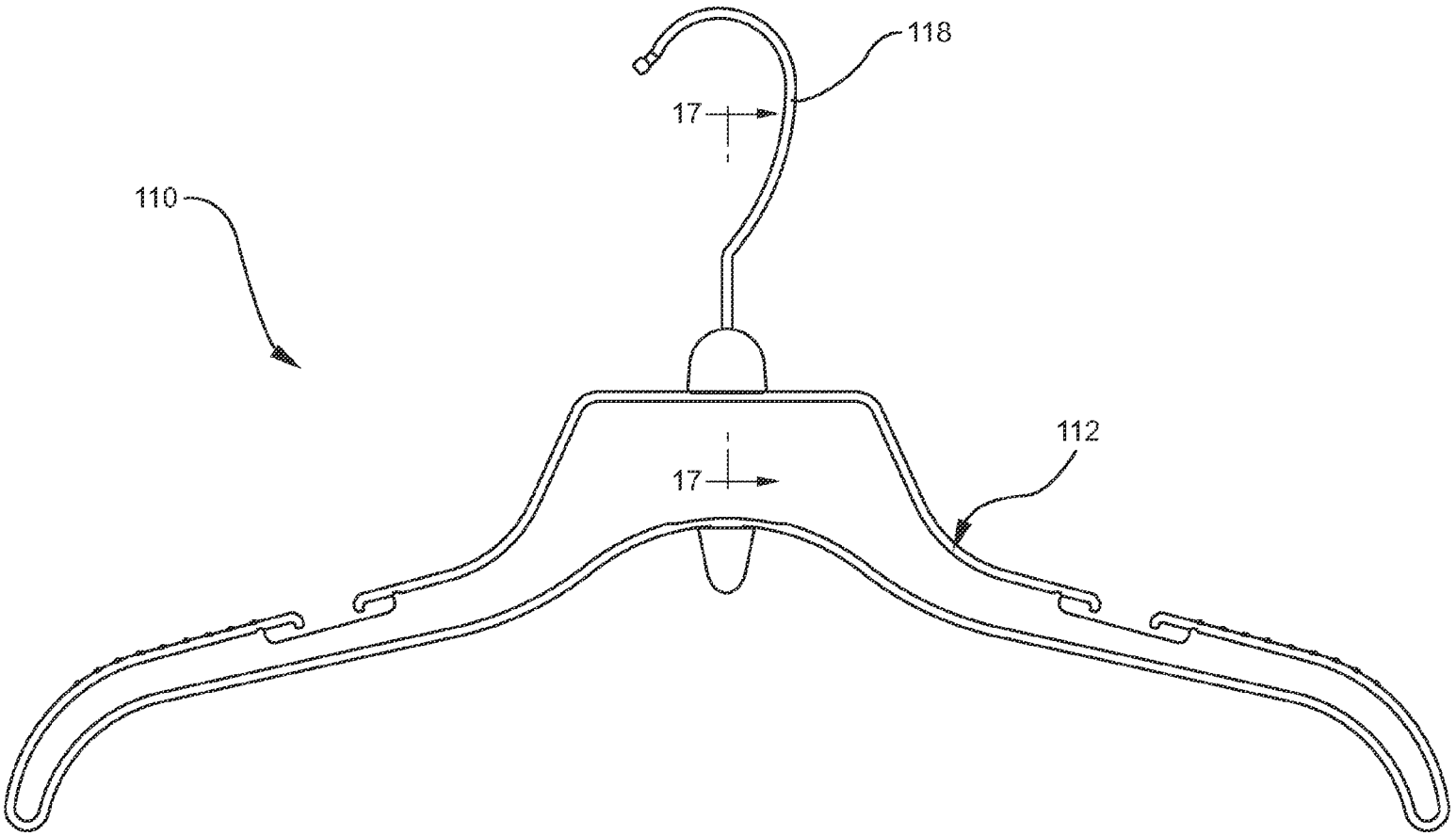
FIG. 13 is a front elevation view of the hanger of FIG. 12 with the hook in an upright position.
Figure 14:
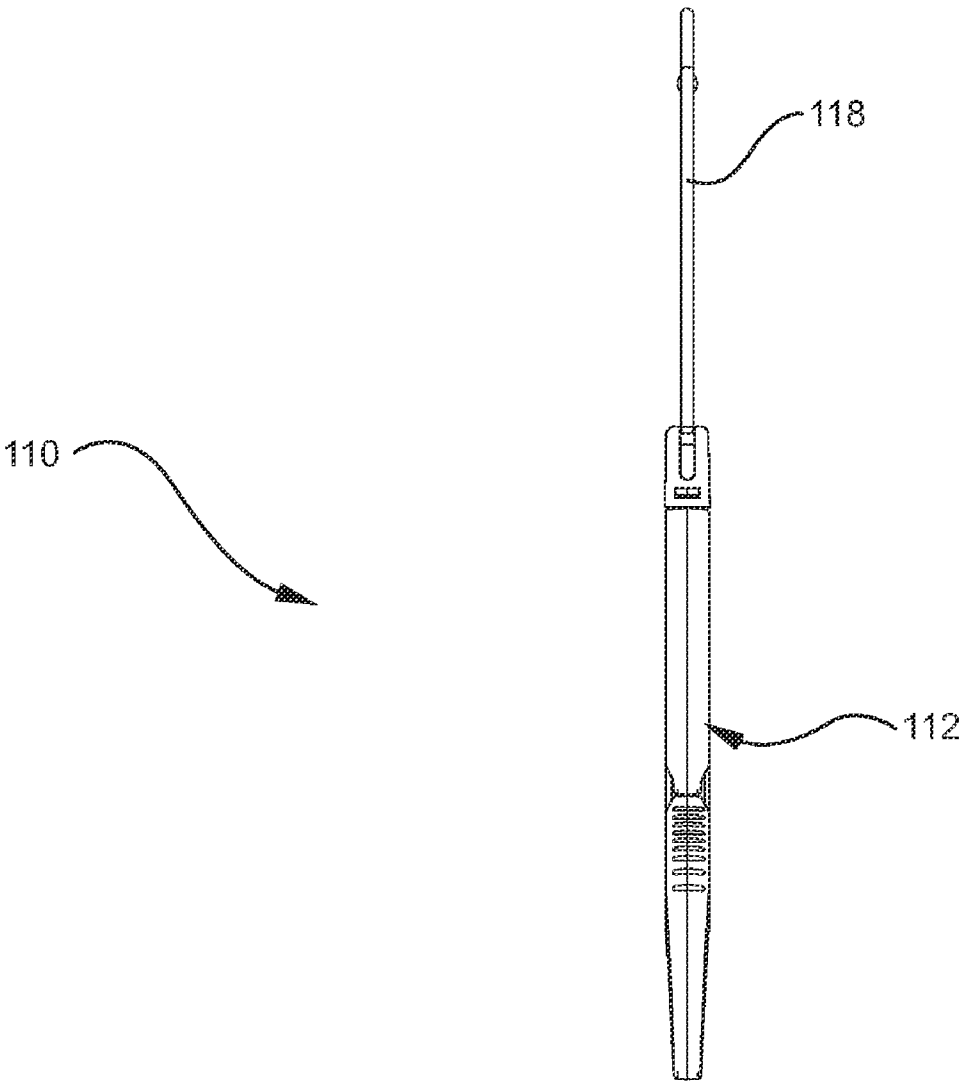
FIG. 14 is a side view of the hanger of FIG. 13.

Hanger 110 includes a metal hook 118, which is shown in a folded state in FIG. 12. More particularly, hook 118 is rotatable between the folded position shown in FIG. 12 and the upright position shown in FIGS. 13-14. When the hook is in the upright position, hanger 110 functions as a conventional garment hanger for supporting and displaying a garment. However, during transportation/shipping, hook 118 can be moved to the folded position (see FIG. 12) to reduce the footprint of the hanger, and thus the overall size of the shipping box/container into which the garments are loaded. The reduction in size of the shipping box/container translates into reduced shipping costs.

Figure 15:
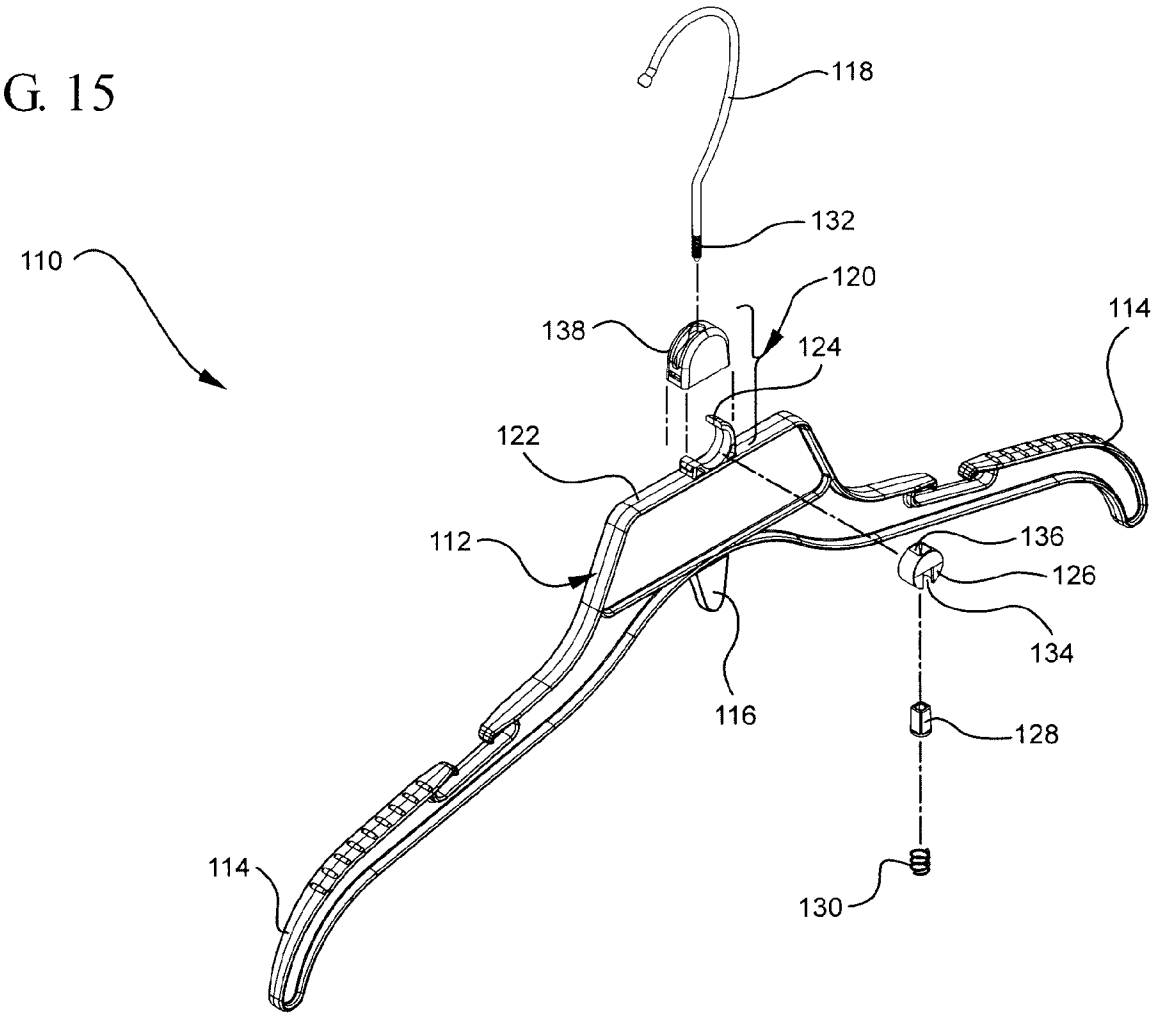
FIG. 15 is an exploded perspective view of the hanger of FIG. 12.
Figure 16:
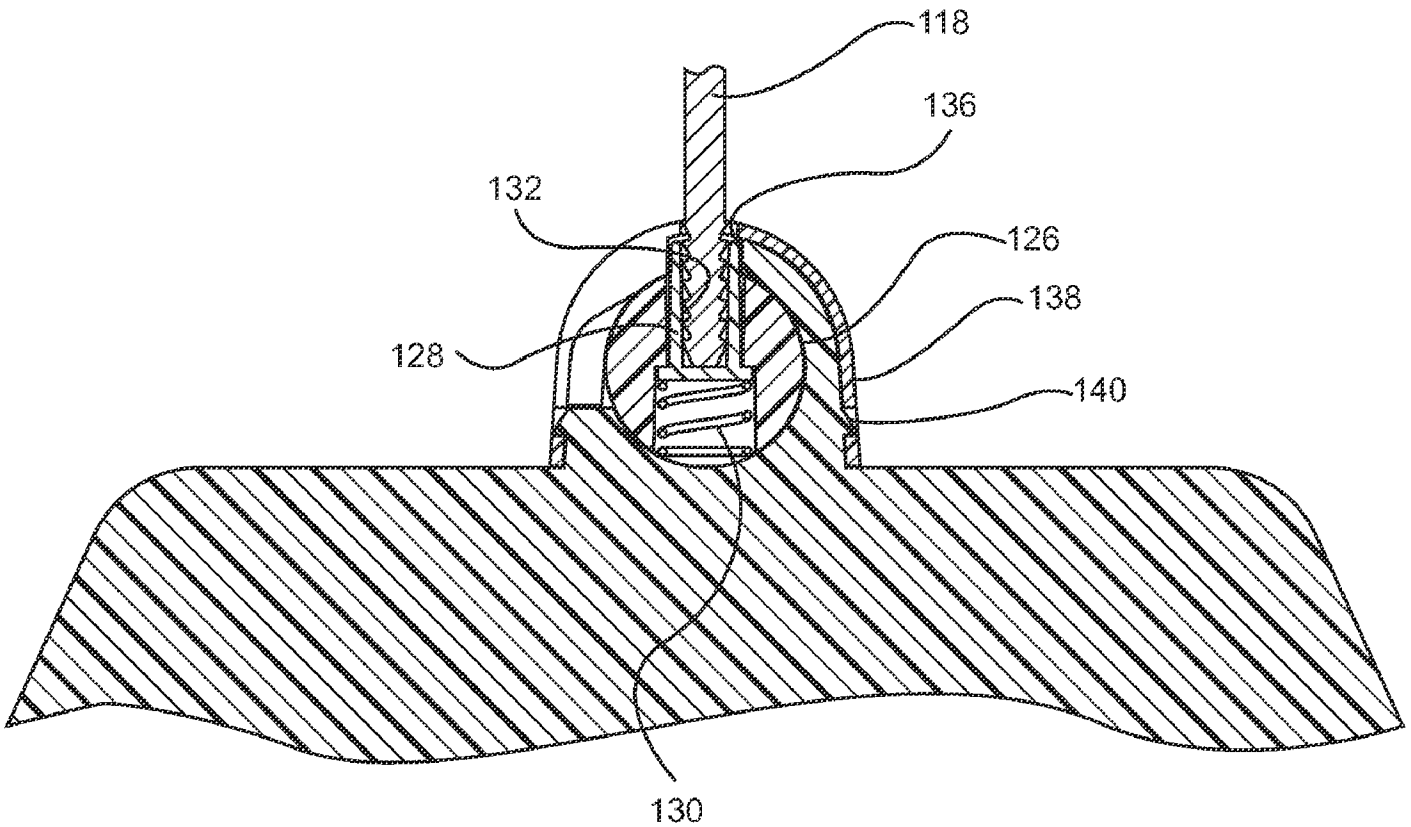
FIG. 16 is a cross-sectional view taken along line 16-16 of FIG. 13.
Figure 17:
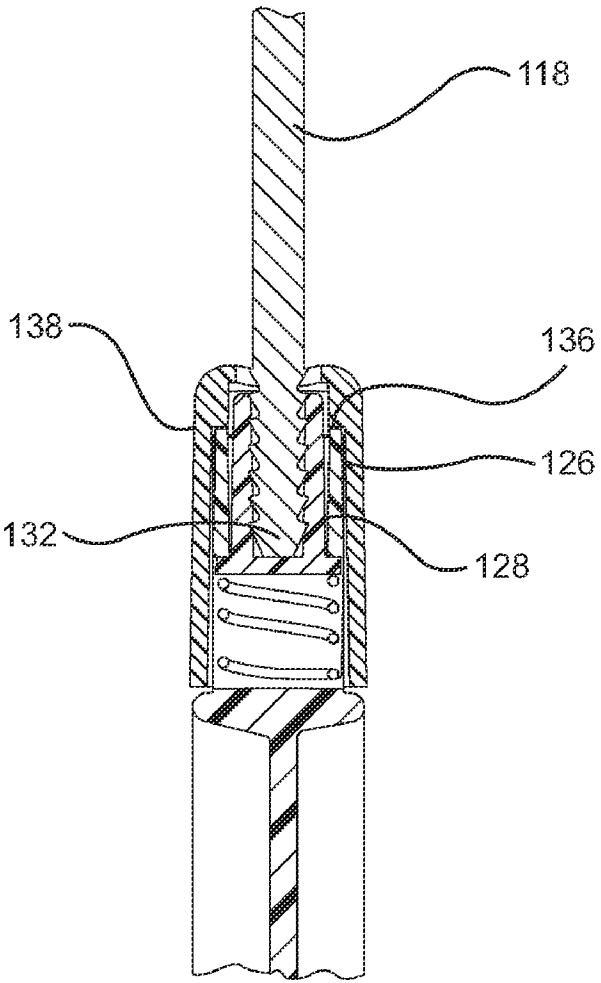
FIG. 17 is a cross-sectional view taken along lines 17-17 of FIG. 14.

Hanger 110 of the present invention includes a hook receiving fixture 120 located along an upper edge 122 of body portion 112. Referring now to FIG. 15, hook receiving fixture 120 includes a frame 124, which is preferably integrally molded with edge 122. Fixture 120 further includes a circular drum 126, a threaded boss 128 and a spring 130. These components are shown in an exploded format in FIG. 15. As best seen in FIGS. 16-17, threaded tip 132 of hook 118 is threaded into boss 128. Boss 128 is sized for insertion within a lower opening 134 of drum 126. Spring 130 is also sized to be positioned within lower opening 134. When assembled, boss 128 extends through upper opening 136 of drum 126.

The completed assembly is positioned within frame 124, and cover 138 is thereafter positioned over hook 118 and about frame 124.

Cover 138 is configured to snap-fit about frame 124, as best seen in FIG. 16. In particular, frame 124 preferably includes a pair of opposing tabs 140 (FIG. 16) which snap into and engage corresponding recesses 142 (FIG. 18) located within the walls of cover 138. Cover 138 is thus retained in position over frame 124, thereby securing drum 126 in rotatable engagement with frame 124. Cover 138 further includes a slot 144 through which hook 118 extends. Slot 144 is sized to allow hook 118 to move from the upright position to the folded position.

Figure 18:
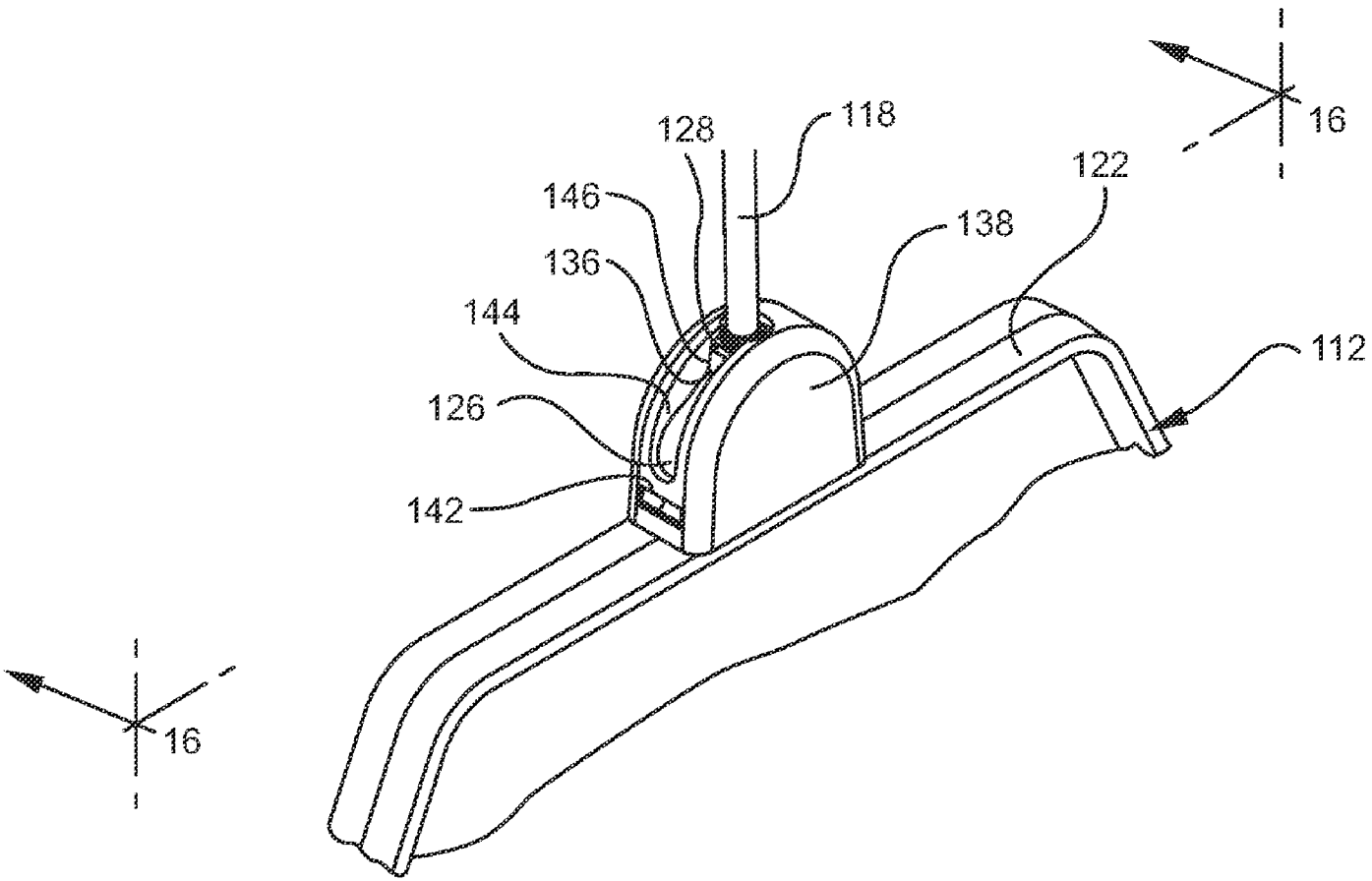
FIG. 18 is a detail of the hook-receiving fixture of FIG. 12 showing the hook in its locked upright position.
Figure 19:
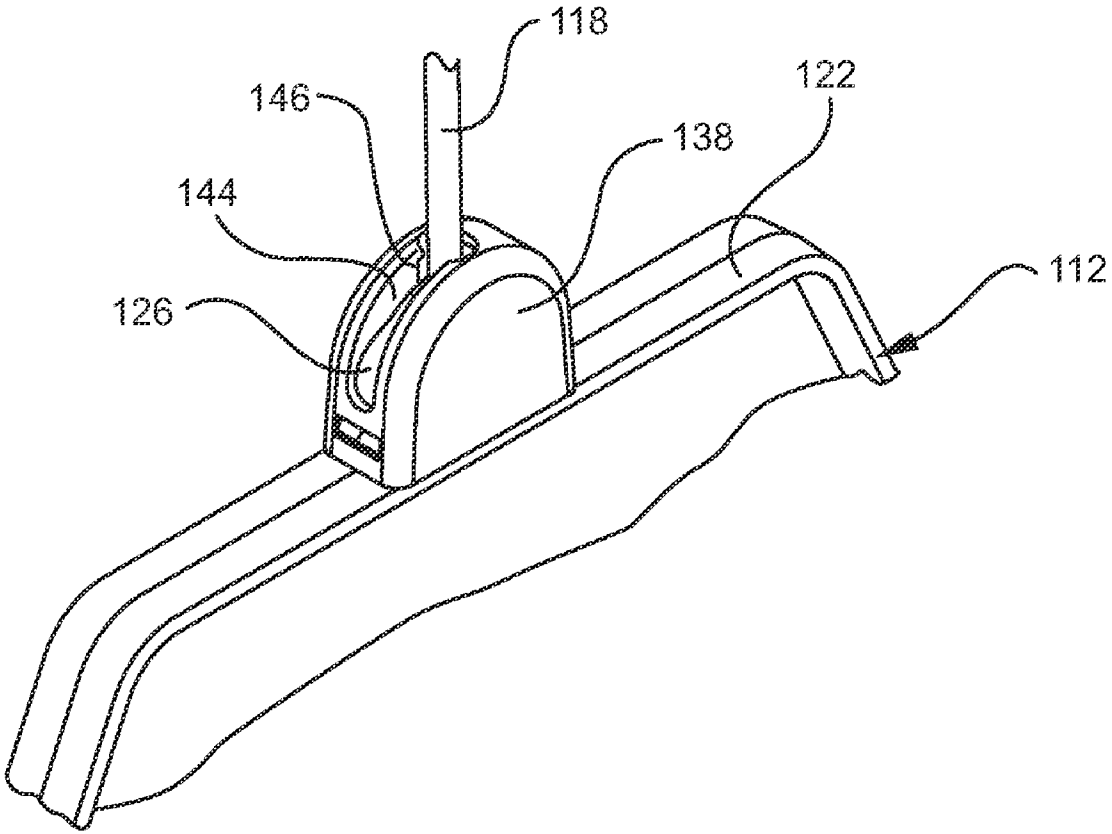
FIG. 19 is another detail of the hook-receiving fixture of FIG. 12 showing the hook in an upright position but in an unlocked state.
Figure 20:
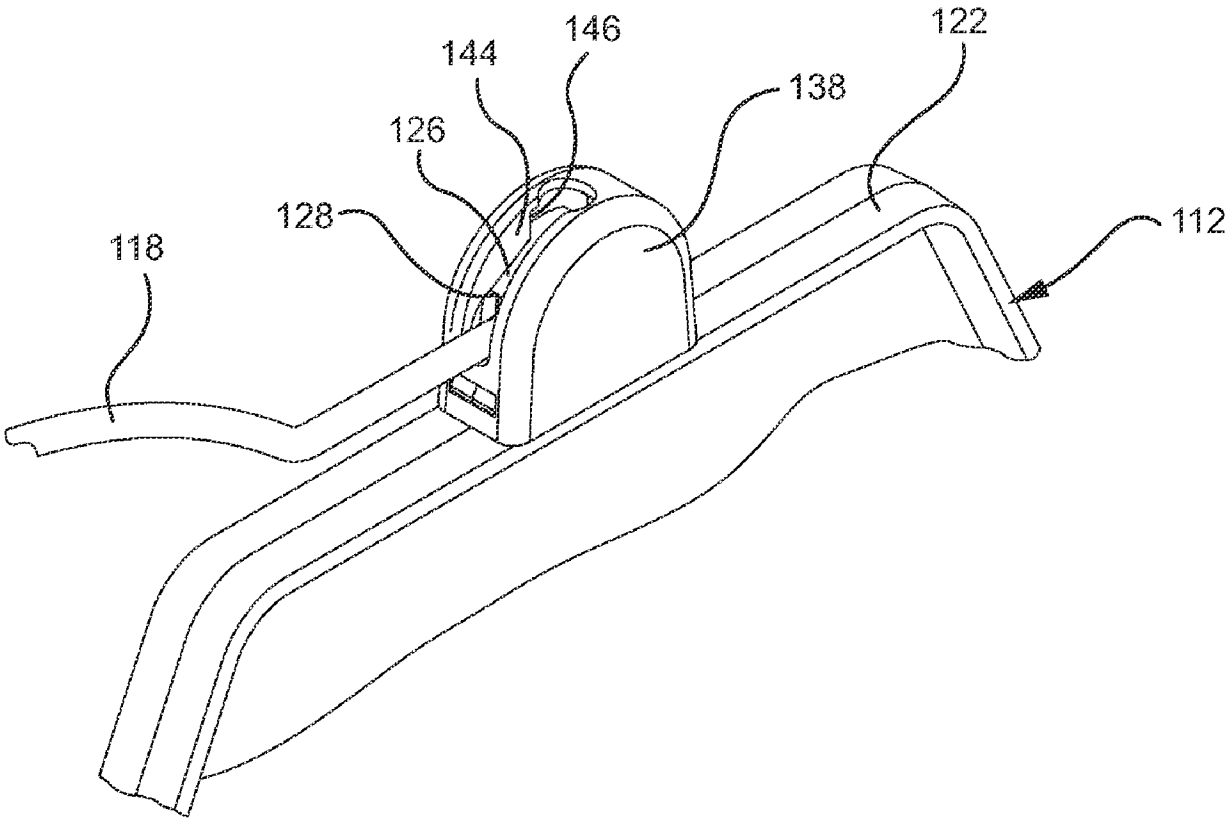
FIG. 20 is still another detail of the hook-receiving feature of FIG. 12 showing the hook rotated to the folded position.

It will be appreciated by those skilled in the art that a collapsible hook hanger will preferably includes a locking mechanism which locks the hook of the hanger in an upright position during normal usage. The novel arrangement of the components of the present invention provides a mechanism which is cost effective to manufacture, easy to assemble and which provides for the mentioned locking mechanism. This locking arrangement is best seen in FIGS. 18 to 20. As previously mentioned, boss 128 is sized to extend through upper opening 136 of drum 126. Spring 130 is positioned within drum 126 to urge boss 128 outward through upper opening 134. This position, which is the locked position, is shown in FIG. 18. In this locked position, the portion of boss 128 extending through opening 136 engages walls 146 of cover 138. Thus, in the locked position, hook 118 is prevented from rotation.

To rotate hook 118 to the folded state, the hook is pressed towards body portion 112 against the bias of spring 130, thereby retracting boss 128 within drum 126 (as shown in FIG. 19). In this position, there is no longer engagement between boss 128 and walls 146 of cover 138. At this point, hook 118 can be rotated to its folded position (see FIG. 20), which results in drum 126 rotating within frame 124. During this period of rotation, boss 128 remains captured within drum 126.

As discussed hereinabove, this folded state provides a reduced footprint for the hanger, thereby reducing the size of the packaging boxes/containers required to transport the garments positioned on the hangers. Once the hangers/garments reach the retail location, the garments/hangers are removed from the boxes/containers, and the hook is rotated from the folded position to the upright position. Once the hook reaches the upright position, the biasing force of spring 130 will urge boss 128 through upper opening 136 and into engagement with walls 146 of cover 138, thereby locking the hook into the upright position.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendments and/or deviations be included in the scope of the present invention.

The invention claimed is:

1. A collapsible hook hanger, comprising:

a hook having a threaded end;

a hanger body defining a plane P and including an upper edge;

a hook-receiving fixture extending from said edge and including a frame and a substantially circular drum, said frame including a substantially circular opening extending therethrough in a direction substantially perpendicular to said plane P, said frame further including a guide slot extending along a substantial portion of at least one of the sides of said frame and along at least a portion of the top of said frame, said guide slot in communication with said opening, said a substantially circular drum being sized to be rotatably received within said opening in said frame, said drum including a threaded aperture sized to receive said threaded end of said hook when said threaded end is extended through said guide slot whereupon said drum is rotatably captured within said opening of said frame and rotatable between a first upright position and a second folded position.

2. The hanger according to claim 1, further comprising a locking mechanism for locking said hook in said upright position and for locking said hook in said folded position.

3. The hanger according to claim 2, wherein said locking mechanism includes a plurality of detents located on said drum and at least one rib formed on said frame, said rib being positioned to engage one of said detents when said hook is in said upright position and another of said detents when said hook is in said folded position.

4. The hanger according to claim 3, wherein said frame is integrally molded with said edge.

5. The hanger according to claim 2, wherein said frame includes a pair of opposing and outwardly-protruding projections; and further comprising a crown sizer configured to mount about said fixture, said sizer including a pair of opposing shoulders located to engage said projections whereby said sizer may be secured about said fixture, said sizer including a cut away substantially corresponding to said guide slot.

6. A collapsible hook hanger, comprising:

a hook having a threaded end;

a hanger body defining a plane Q and including an upper edge;

a hook-receiving fixture extending from said edge, said fixture including a frame defining an arcuate track, said fixture further including a substantially circular drum sized for receipt within said track and a boss having a threaded aperture sized to receive said threaded end of said hook, said drum including a lower opening for receipt of said boss therein and an upper opening for passage of said threaded end of said hook therethrough whereupon said threaded end of said hook engages said boss, said fixture further including a spring for biasing said boss towards said upper opening of said drum; and a cover sizer and configuring to fit about said frame and secure said drum within said track, said cover including a slot sized to allow passage of said hook therethrough.

7. The hanger according to claim 6, further comprising a locking mechanism for locking said hook in said upright position and for locking said hook in said folded position.

8. The hanger according to claim 7, wherein said locking mechanism includes said boss and said spring, and wherein said spring biases said boss through said upper opening and into engagement with said cover when said hook in said upright position, and wherein said boss is retracted into said drum and out of engagement with cover when said hook is in said folded position.

9. The hanger according to claim 8, wherein both said boss and said upper opening are formed with a rectangular cross-section.

10. The hanger according to claim 8, wherein said frame is integrally molded with said edge.

* * * * *

UNITED STATES PATENT AND TRADEMARK OFFICE

CERTIFICATE OF CORRECTION

PATENT NO. : 8,113,393 B2
APPLICATION NO. : 12/419754
DATED : February 14, 2012
INVENTOR(S) : Ho It is certified that error appears in the above-identified patent and that said Letters Patent is hereby corrected as shown below:

At Column 6, line 5 (Claim 1, line 13), "said a substantially circular" should be --said substantially circular--.

Signed and Sealed this
Third Day of April, 2012

David J. Kappos

David J. Kappos
*Director of the United States Patent and Trademark Office*